US009118986B2

(12) United States Patent
Hsieh

(10) Patent No.: US 9,118,986 B2
(45) Date of Patent: Aug. 25, 2015

(54) FLAT SPEAKER OUTPUT DEVICE AND METHOD FOR STARTING THE SAME

(71) Applicant: AMAZING MIRCOELECTRONIC CORP., New Taipei (TW)

(72) Inventor: Ming Che Hsieh, Taichung (TW)

(73) Assignee: AMAZING MICROELECTRONIC CORP., New Taipei (TW)

( * ) Notice: Subject to any disclaimer, the term of this patent is extended or adjusted under 35 U.S.C. 154(b) by 345 days.

(21) Appl. No.: 13/759,678

(22) Filed: Feb. 5, 2013

(65) Prior Publication Data

US 2014/0126749 A1 May 8, 2014

(30) Foreign Application Priority Data

Nov. 2, 2012 (TW) ..... 101140710 A

(51) Int. Cl.
*H04R 3/00* (2006.01)
*H04R 29/00* (2006.01)

(52) U.S. Cl.
CPC ..... *H04R 3/00* (2013.01); *H04R 29/002* (2013.01)

(58) Field of Classification Search
CPC ..... H04R 29/002; H04R 3/00
USPC ..... 381/55, 58, 59, 61, 77, 80–82, 85, 86, 381/94.8, 98, 111, 116, 120, 176, 191
See application file for complete search history.

(56) References Cited

U.S. PATENT DOCUMENTS

| | | | | |
|---|---|---|---|---|
| 3,992,585 | A * | 11/1976 | Turner et al. | 381/110 |
| 4,323,736 | A * | 4/1982 | Strickland | 381/116 |
| 6,459,799 | B1 * | 10/2002 | Smits | 381/191 |
| 7,397,923 | B2 | 7/2008 | Konagai | |
| 8,290,197 | B2 * | 10/2012 | Buining et al. | 381/394 |
| 2005/0147265 | A1 * | 7/2005 | Smits et al. | 381/191 |
| 2007/0189559 | A1 * | 8/2007 | Haan et al. | 381/191 |
| 2007/0242844 | A1 * | 10/2007 | Harman | 381/191 |
| 2009/0041266 | A1 * | 2/2009 | Guo et al. | 381/98 |
| 2010/0303263 | A1 * | 12/2010 | Hiensch | 381/191 |
| 2012/0033834 | A1 * | 2/2012 | Mellow et al. | 381/120 |

* cited by examiner

*Primary Examiner* — Vivian Chin
*Assistant Examiner* — Friedrich W Fahnert
(74) *Attorney, Agent, or Firm* — Muncy, Geissler, Olds & Lowe, P.C.

(57) ABSTRACT

The present invention discloses a flat speaker output device and a method for starting the same. Wherein, a plurality of flat speakers utilizes an initial delay unit and a plurality of intermediary delay units connected in series. The initial delay unit connects with the power controller and a first one of the flat speakers. The intermediary delay units respectively connect with the residual each flat speakers. The power controller controls a power source to the initial delay unit to delay the start of the first one of flat speakers, and outputs the power source to the intermediary delay units to sequentially delay the starts time of the residual each flat speaker. The present invention can sequentially start flat speakers without using a high-output power supply device and thus decrease the required capacity of the external power supply device.

5 Claims, 2 Drawing Sheets

FLAT SPEAKER OUTPUT DEVICE AND METHOD FOR STARTING THE SAME

BACKGROUND OF THE INVENTION

1. Field of the Invention

The present invention relates to a flat speaker output device and a method for starting the same, particularly to a flat speaker output device whose flat speakers are started sequentially and a method for starting the same.

2. Description of the Related Art

With advance of science and technology, speakers have been very popular in families, theaters, automobiles, amusement places, and other establishments needing sound display. Because of the trend to fabricate slim and compact electronic products, how to miniaturize speakers and control the operation thereof has been the hot subject in the field concerned.

For an environment equipped with a lot of speakers (such as an establishment needing a surround sound effect), all the speakers are connected in parallel with power cables and started simultaneously by a high-output power supply device. However, the power supply device to start a lot of speakers simultaneously is bulky, hard to transport and very power-consuming. Moreover, the power supply is likely to be unstable, which will cause poor sound display quality. Besides, too high an inrush current may damage the speakers or shorten the service life of the speakers while a power supply device outputs high current to start the speakers.

Accordingly, the present invention proposes a flat speaker output device and a method for starting the same to overcome the abovementioned problems.

SUMMARY OF THE INVENTION

The primary objective of the present invention is to provide a flat speaker output device and a method for starting the same, wherein a plurality of flat speakers and a plurality of delay circuits are connected in series, and wherein each the flat speaker is controlled to start at different time points sequentially, whereby is avoided too great an inrush current occurring during the starts of the flat speakers, and whereby power is saved.

To achieve the abovementioned objective, the present invention proposes a flat speaker output device, which comprises a plurality of flat speakers, a set of delay circuits, and a power controller. The power controller connects with the flat speakers and the set of delay circuit. The set of delay circuit respectively connect with each the flat speaker is connected in series. The delay circuits sequentially delay the starts time of each the flat speaker. While power is turned on, the power controller outputs power source to the set of delay circuit. The delay circuits sequentially start each the flat speaker at different time points. The sequential start of each the flat speaker can save electric power and demands a smaller external power supply.

The present invention also proposes a method for starting flat speakers, which applies to a plurality of flat speakers connected in series, and which comprises steps: providing power source; using the power source to start a first one of flat speakers; and delaying the time points of supplying the power source to the flat speakers to sequentially start each the flat speaker.

Below, embodiments are described in detail to make easily understood the objectives, technical contents, characteristics and accomplishments of the present invention.

DETAILED DESCRIPTION OF THE INVENTION

Figure 1:
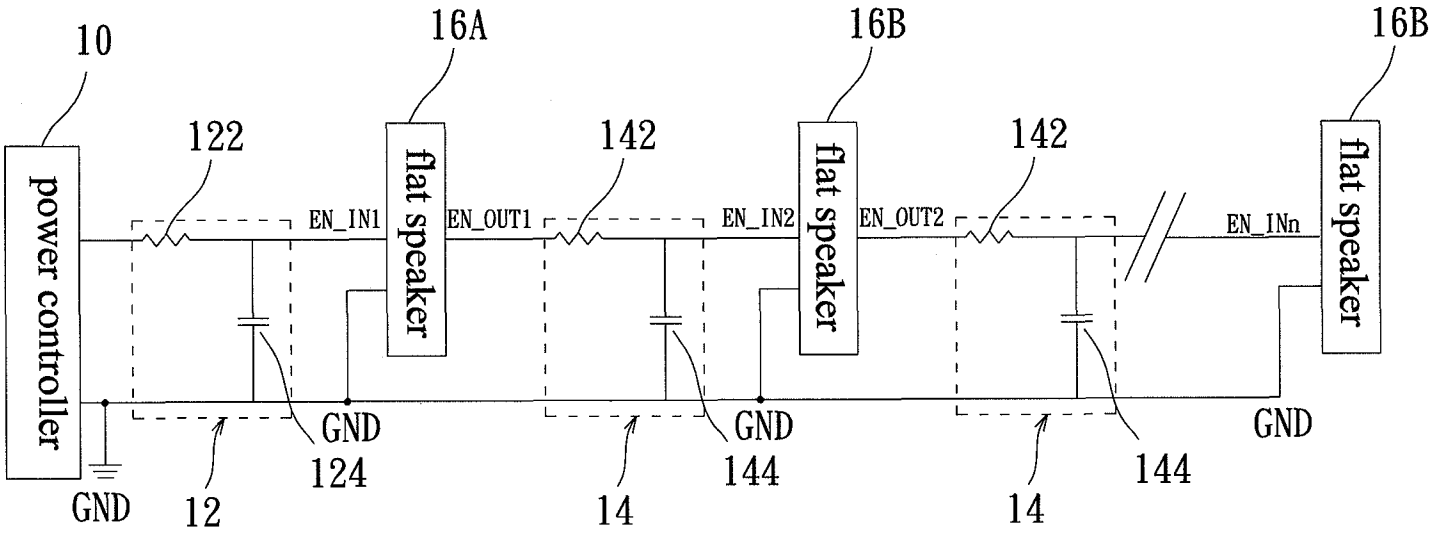
FIG. 1 schematically shows the circuit architecture of a flat speaker output device according to one embodiment of the present invention.

Refer to FIG. 1 for the circuit architecture of a flat speaker output device according to one embodiment of the present invention. The flat speaker output device of the present invention comprises a plurality of flat speakers, a set of delay circuits, and a power controller 10. The power controller 10 connects with the flat speakers and the delay circuits. In one embodiment, the flat speakers are electrostatic flat speakers. The set of delay circuits includes an initial delay unit 12 and a plurality of intermediary delay units 14. The initial delay unit 12 connects with the power controller 10 and the input terminal of a first one of flat speakers 16A. The other flat speakers 16B are connected in series by the intermediary delay units 14.

The initial delay unit 12 includes a first resistor 122 and a first capacitor 124, which are connected in series. The two terminals of the first resistor 122 respectively connect with the power source terminal of the power controller 10 and the positive electrode of the first capacitor 124. The negative electrode of the first capacitor 124 connects with the ground terminal (GND) of the power controller 10. The output terminal of the first output capacitor 124 connects with the input terminal (EN_IN1) of the first one of flat speakers 16A, which are connected in series.

Each the intermediary delay unit 14 includes a second resistor 142 and a second capacitor 144, which are connected in series, and which are respectively connected with the output terminal (EN_OUT2) of the corresponding flat speaker 16B and the input terminal (EN_IN2) of the adjacent flat speaker 16B. For example, the second resistor 142 of the first one of intermediary delay units 14 connects with the output terminal (EN_OUT1) of the first one of flat speakers 16A, and the second capacitor 144 of the first one of intermediary delay units 14 connects with the input terminal (EN_IN2) of the second one of flat speakers 16B. Similarly, the second resistor 142 of the second one of intermediary delay units 14 connects with the output terminal (EN_OUT2) of the second one of flat speakers 16B, and the output terminal of the second capacitor 144 of the second one of intermediary delay units 14 connects with the input terminal (EN_IN3) of the third one of flat speakers 16B. The abovementioned connection way is repeated to enable the initial delay unit 12 and the intermediary delay units 14 to connect all the flat speakers in series. The positive electrode and negative electrode of the second capacitor 144 respectively connect with the second resistor 142 and the ground terminal of the power controller 10. Therefore, the first capacitor 124 and the second capacitor 144 share a common ground point. Thereby, the power controller 10 and the flat speakers are connected in series by the initial delay unit 12 and the intermediary delay units 14 to form a connect loop.

Figure 2:
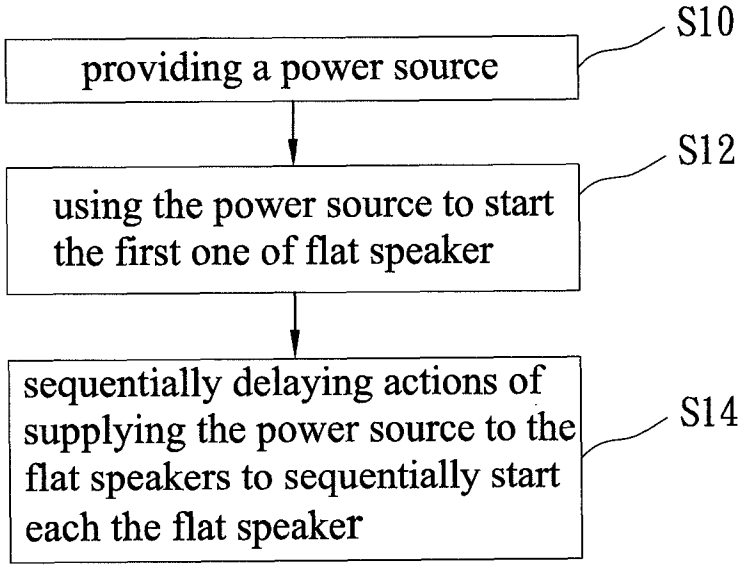
FIG. 2 shows a flowchart of a method for starting flat speakers according to one embodiment of the present invention.

After the description of the circuit of the present invention, the method to start the flat speaker output device is described below. Refer to FIG. 2 for a flowchart of the method for starting a flat speaker output device according to one embodiment of the present invention. While the user intends to start a plurality of flat speakers connected in series, firstly, in step S10, a power supply (such as a supply mains) providing a power source. The power supply is connected with the power controller 10. Next, as shown in step S12, the power controller 10 controls the power source to start the first one of flat speakers 16A. The initial delay unit 12 is used to delay the start of the first one of flat speakers 16A. In other words, the length of the charge-discharge cycle of the first resistor 122 and first capacitor 124 is designed to delay the start of the first one of flat speakers 16A via varying the resistance of the first resistor 122 and the capacitance of the first capacitor 124. Next, in step S14, the intermediary delay units 14 sequentially delay the actions of supplying the power to the flat speakers 16B to sequentially start each the flat speaker 16B. In other words, the second resistors 142 and the second capacitors 144 cooperate to function as power-delaying circuits. The user can vary the resistances and capacitances to adjust the time lags caused by the charge and discharge of the second resistors 142 and second capacitors 144 according to requirement. Thereby, the intermediary delay units 14 sequentially delay the actions of supplying the power source to the corresponding flat speakers 16B. Thus, each the flat speaker 16B is started in sequence.

In the prior arts, a high-output power source is required to simultaneously start a plurality of speakers. For example, a power source able to output 50 A current is required to simultaneously start 50 speakers each needing 1 A start current. In the conventional start method, the power supply device correlates with the number of speakers and has to output higher power to start the speakers simultaneously. Moreover, the speakers may be damaged by too high an inrush current at the moment of starting the speakers in the conventional technology. Accordingly, the present invention makes a set of delay circuits respectively connect with a plurality of flat speakers and sequentially delay the starts of each the flat speaker. It is sufficient for the present invention to only consider the average operating current of each flat speaker (such as 100 mA). As each the flat speaker is sequentially started at different time points in the present invention, a power supply outputting 5 A current is sufficient to start and operate 50 flat speakers. The present invention can effectively overcome the problem of too high an inrush current at the moment of starting the flat speakers, using the time-lag function and wave-filtering function of the delay circuits. In comparison with the conventional technology, the present invention can indeed reduce the required capacity and size of the external power supply device and decrease power consumption.

The embodiments described above are only to exemplify the present invention but not to limit the scope of the present invention. Any equivalent modification or variation according to the characteristic or spirit of the present invention is to be also included within the scope of the present invention.

What is claimed is:

1. A flat speaker output device comprising:

a plurality of flat speakers (16A, 16B), which are electrostatic flat speakers;

a set of delay circuits comprising an initial delay unit (12) and a plurality of intermediary delay units (14) for sequentially delaying starts of each said flat speaker, wherein said initial delay unit comprises a first resistor (122) and a first capacitor (124) connected in series, an output terminal of said first capacitor being connected with an input terminal of said first one of said flat speakers (16A); and each said intermediary delay unit (14) is connected between the other said flat speakers such that the other said flat speakers are connected in series by said intermediary delay units, wherein each said intermediary delay unit further comprises a second resistor (142) and a second capacitor (144) connected in series, said second resistor and said second capacitor respectively are connected with an output terminal of one corresponding said flat speaker and an input terminal of one adjacent said flat speaker, whereby said flat sneakers utilize said initial delay unit and said intermediary delay units connected in series; and a power controller (10) connecting with said flat speakers and said initial delay unit, wherein said initial delay unit (12) connects with said power controller and an input terminal of first one of said flat speakers (16A), said first resistor and said first capacitor respectively connect with a power source terminal and a ground terminal of said power controller, and a negative electrode of said second capacitor is further connected with said ground terminal whereby said power controller controlling a power source to output power to said initial delay unit and said intermediary delay units to enable said initial delay unit and said intermediary delay units to sequentially start each said flat speaker.

2. The flat speaker output device according to claim 1, wherein said initial delay unit and said intermediary delay units utilize charging and discharging of said first capacitor and said second capacitors to sequentially delay starts of each said flat speaker.

3. A method for starting said flat speaker output device comprising said plurality of flat speakers, said initial delay unit, said intermediary delay units and said power controller according to claim 1, comprises steps:

providing said power source;

using said power source to start said first one of said flat speakers (16A); and sequentially delaying actions of supplying said power source to the other flat speakers (16B) to sequentially start each said flat speaker.

4. The method for starting said flat speaker output device according to claim 3, wherein said power source is output by said power controller to said flat speakers.

5. The method for starting said flat speaker output device according to claim 3, wherein said step of delaying said power source utilizes said initial delay unit and said intermediary units to delay actions of supplying said power source to said flat speakers to sequentially start each said flat speaker.

* * * * *